US006676232B2

(12) United States Patent
Fulop

(10) Patent No.: US 6,676,232 B2
(45) Date of Patent: Jan. 13, 2004

(54) DISPLAY SYSTEM

(76) Inventor: Raymond C. Fulop, 17005 Stag Thicket La., Strongsville, OH (US) 44136

( * ) Notice: Subject to any disclaimer, the term of this patent is extended or adjusted under 35 U.S.C. 154(b) by 0 days.

(21) Appl. No.: 10/113,515

(22) Filed: Apr. 1, 2002

(65) Prior Publication Data

US 2003/0184192 A1 Oct. 2, 2003

(51) Int. Cl.[7] ..... A47F 3/00
(52) U.S. Cl. ..... 312/122; 312/119
(58) Field of Search ..... 312/114, 117, 312/122, 330.1, 286, 126, 334.13

(56) References Cited

U.S. PATENT DOCUMENTS

| | | | | | |
|---|---|---|---|---|---|
| 2,988,412 | A | | 6/1961 | Vannice | |
| 3,032,381 | A | | 5/1962 | Boro | |
| 3,251,636 | A | | 5/1966 | Hein | |
| 3,434,769 | A | | 3/1969 | Salet | |
| 4,108,515 | A | * | 8/1978 | Johnson | 312/119 |
| 4,156,549 | A | * | 5/1979 | Clark | 312/270.3 |
| 4,396,121 | A | * | 8/1983 | Lemmon | 206/566 |
| 4,811,996 | A | * | 3/1989 | Hansson | 312/132 |
| 5,306,077 | A | | 4/1994 | Trevaskis | |
| 5,690,402 | A | | 11/1997 | Koppe | |
| 5,871,263 | A | | 2/1999 | Johnston et al. | |
| 5,924,778 | A | * | 7/1999 | TenBrink | 312/114 |
| 6,158,578 | A | * | 12/2000 | Greiner | 206/6.1 |
| 6,189,594 | B1 | | 2/2001 | Carter | |
| 6,425,646 | B1 | * | 7/2002 | Andrews | 312/114 |

* cited by examiner

*Primary Examiner*—Kimberly Wood
*Assistant Examiner*—Kofi Schulterbrandt
(74) *Attorney, Agent, or Firm*—Fay, Sharpe, Fagan, Minnich & McKee, LLP

(57) ABSTRACT

A frame structure is provided for holding a plurality of display cases. Each of the plurality of display cases has an upper cavity viewable through the upper end. The frame structure is adapted to permit viewing of each of the upper ends of the plurality of display cases. The frame structure includes a first end wall and a second end wall. A pair of sidewalls extend between the first and second end walls. The end walls and sidewalls define a base cavity adapted to receive an associated base display case. The pair of sidewalls have upper portions that extend a selected distance beyond the top surfaces of the first and second end walls. A first pair of slide mechanisms is mounted on the upper portions of the pair of sidewalls. A first display case support is connected to the first pair of slide mechanisms and is adapted to carry an associated first display case. The first pair of slide mechanisms is capable of slidably moving the first display case support between a first position wherein the carried associated first display case is positioned over the base cavity substantially obstructing viewing into the base cavity and a second position wherein the carried associated display case passes over one of the top edges of the first and second end walls thereby not substantially obstructing viewing into the base cavity.

21 Claims, 8 Drawing Sheets

DISPLAY SYSTEM

BACKGROUND OF THE INVENTION

The present invention relates to display systems and structures. More particularly, the present invention relates to a frame structure for holding a plurality of display cases. However, it will be appreciated that the present invention is also amenable to other like applications.

It is well known that display cases are used to display merchandise for sale at the retail level. Further, it is well known that conventional display cases manufactured by Arizona Case and Allstate Display Case are commonly used by retailers at trade shows, jewelry shows, coin collector shows, baseball card and general sports memorabilia shows, flea markets, to name a few. These types of display cases (FIG. 2) are substantially flat rectangular boxes having a glass door as an upper end or side permitting viewing of the contents contained within the display case and openable to provide access to said contents.

One of the problems frequently confronting retailers at these types of shows is limited table space. That is, a retailer is only given a specific amount of table space upon which to place his/her display cases. Without more tabletop surface area, the retailer is limited in the amount of merchandise he/she can display.

Accordingly, there is a need for a display system that optimally permits viewing of a plurality of display cases while reducing the amount of tabletop surface area required to show the display cases. The present invention provides a new and improved display system for overcoming the above-referenced drawbacks and others.

BRIEF SUMMARY OF THE INVENTION

In accordance with one aspect of the present invention, a new and improved frame structure is provided for holding a plurality of display cases. Each of the plurality of display cases has an upper end and an inner cavity viewable through the upper end. The frame structure is adapted to permit viewing of each of the upper ends of the plurality of display cases.

The frame structure includes a first end wall having first and second ends and a top edge. A second end wall is spaced apart from the first end wall in generally parallel orientation relative to the first end wall. The second end wall has first and second ends and a top edge. A pair of sidewalls extend between the first and second end walls. A first sidewall of the pair of sidewalls is connected at a first end to the first end wall first end and at a second end to the second end wall first end. A second sidewall of the pair of sidewalls is connected at a first end to the first end wall second end and at a second end to the second end wall second end. The end walls and sidewalls define a base cavity adapted to receive an associated base display case. The pair of sidewalls have upper portions that extend a selected distance beyond the top surfaces of the first and second end walls.

A first pair of slide mechanisms is mounted on the upper portions of the pair of sidewalls. A first slide mechanism of the first pair of slide mechanisms is mounted on the first sidewall. A second corresponding slide mechanism of the first pair of slide mechanisms is mounted on the second sidewall.

A first display case support is connected to the first pair of slide mechanisms and is adapted to carry an associated first display case. The first pair of slide mechanisms is capable of slidably moving the first display case support between a first position wherein the carried associated first display case is positioned over the base cavity substantially obstructing viewing into the base cavity and a second position wherein the carried associated display case passes over one of the top edges of the first and second end walls thereby not substantially obstructing viewing into the base cavity.

In accordance with another aspect of the present invention, a display system for holding and viewing one or more display cases is provided.

The display system includes a first sidewall and a second sidewall connected to the first sidewall. The second sidewall is spaced apart from the first sidewall. A first region is disposed between the first and second sidewalls. A first pair of slide members is disposed on the first and second sidewalls for supporting an associated display case within the first region. The slide members are movable for transporting the associated first display case toward a position outside the first region.

BRIEF DESCRIPTION OF THE DRAWINGS

The invention may take form in various components and arrangements of components, and in various steps and arrangements of steps. The drawings are only for purposes of illustrating the presently preferred embodiments and are not to be construed as limiting the invention.

DETAILED DESCRIPTION OF THE PREFERRED EMBODIMENTS

Figure 1:
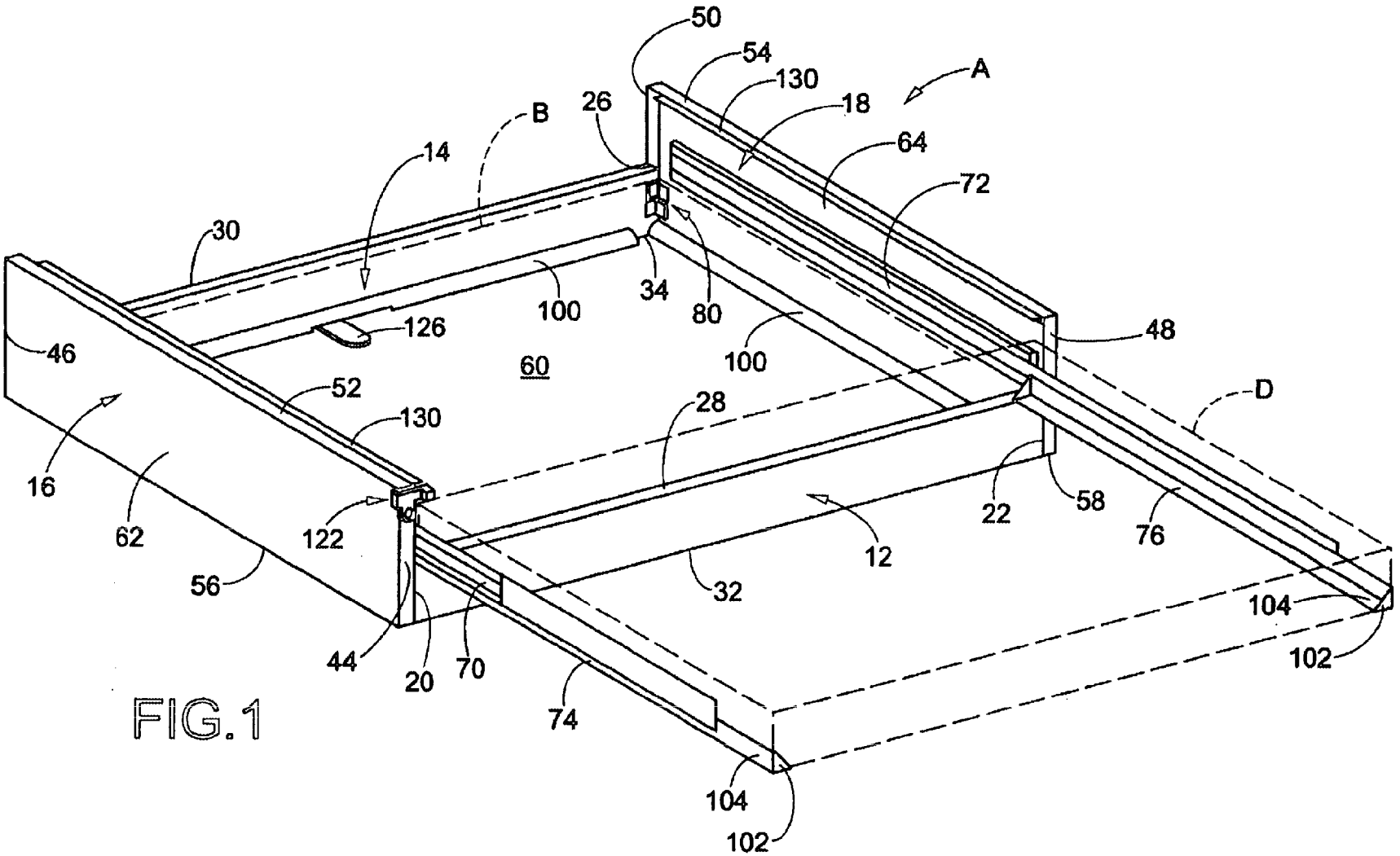
FIG. 1 is a perspective view of a frame structure for holding a plurality of display cases having a first display case support in open position in accordance with a first preferred embodiment of the present invention.

Referring now to the drawings wherein the showings are for purposes of illustrating the preferred embodiments of the invention only and not for purposes of limiting the same, FIG. 1 shows a display system or a frame structure A according to a first preferred embodiment of the present invention. The frame structure A includes a first end wall 12 and a second, opposing end wall 14. The second end wall 14 is spaced apart from the first end wall 12 in generally parallel orientation relative to the first end wall 12. A pair of sidewalls 16,18 extend between the first and second end walls 12,14.

The first end wall 12 includes a first end 20 and second end 22. The second end wall 14 also includes a first end 24 (FIG. 3) and a second end 26. The first end wall 12 includes a top surface or edge 28. The second end wall 14 also includes a top surface or edge 30. Additionally, the first end wall 12 includes a bottom surface or edge 32 and the second end wall 14 includes a bottom surface or edge 34.

Together, the first and second end walls 12,14 and the pair of sidewalls 16,18 form a rectangular box-shaped structure. More specifically, the first sidewall 16 includes a first end 44 and a second end 46. Likewise, the second sidewall 18 includes a first end 48 and a second end 50. The first end 44 of the first sidewall 16 connects to the first end 20 of the first end wall 12. The second end 46 of the first sidewall 16 connects to the first end 24 of the second end wall 14. The first end 48 of the second sidewall 18 connects to the second end 22 of the first end wall 12. The second end 50 of the second sidewall 18 connects to the second end 26 of the second end wall 14.

The first sidewall 16 includes a top surface or edge 52 and the second sidewall 18 includes a top surface or edge 54. The first sidewall 16 includes a bottom surface or edge 56 and the second sidewall 18 includes a bottom surface or edge 58.

The rectangular box-shaped structure defined by the walls 12,14,16,18 together define a base cavity or region 60. In the first preferred embodiment depicted in FIG. 1, the base cavity or region is also defined by a surface (not shown) that the frame structure A may be placed upon. More specifically, such a surface would be coplanar with the bottom edges 32,34 of the first and second end walls 12,14 and the bottom edges 56,58 of the sidewalls 16,18. The base cavity 60 is further defined by a plane that is coplanar with the top edges 28,30 of the first and second end walls 12,14. The base cavity 60 can be optimally sized for receiving a display case. A display case positioned in the base cavity 60 is referred to herein as a base display case B.

Figure 2:
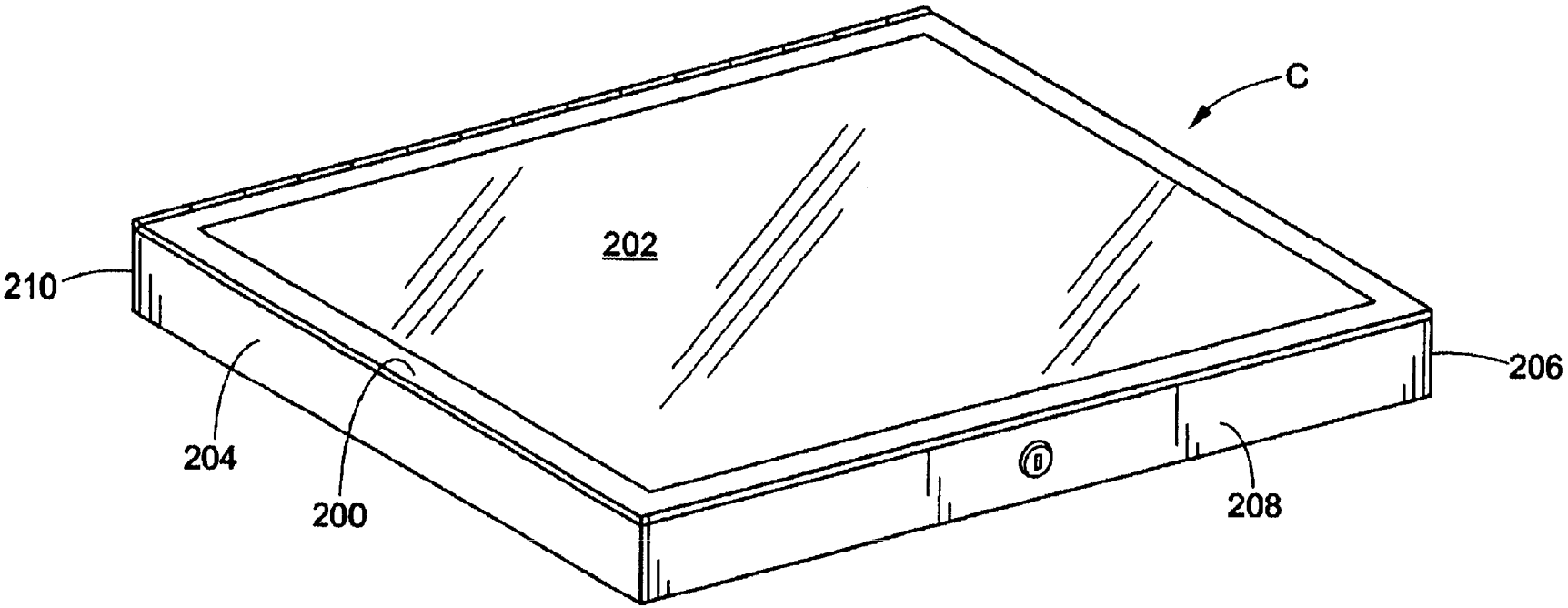
FIG.2 (PRIOR ART)
FIG. 2 is a perspective view of a conventional display case.

Any display case used with the present invention, such as the base display case B, may be a conventional display case such as those manufactured by Arizona Case and Allstate Display Case. With reference to FIG. 2, a conventional display case C is shown. The conventional display case C is a substantially flat rectangular box having an upper side or end 200 that includes a glass portion 202 that permits viewing into a cavity (not shown) defined by the display case C. The display case C further includes lateral sides or edges 204,206, a front side 208 and a rear side 210. The upper end 200 is openable to gain access to the cavity.

Figure 9:
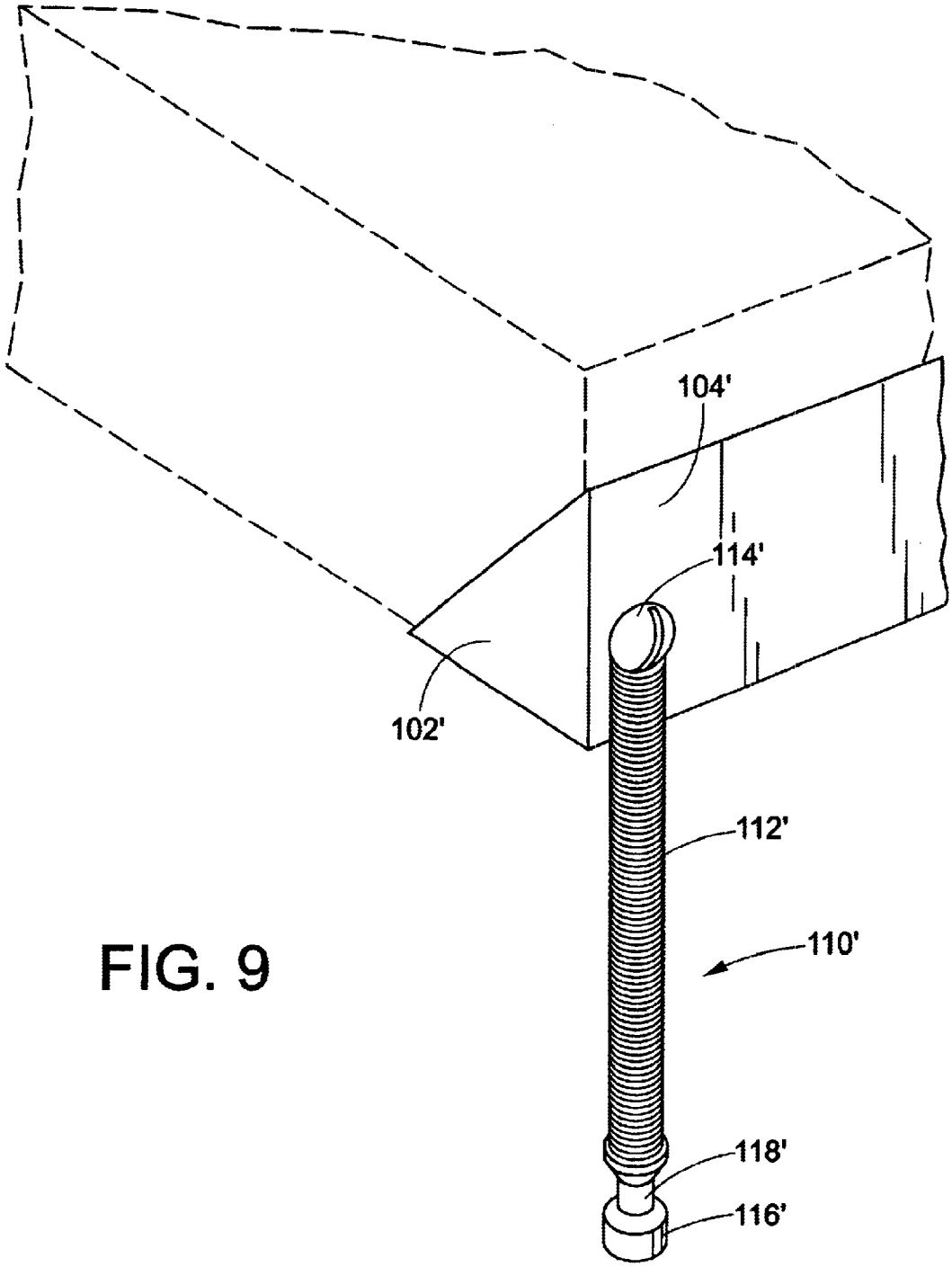
FIG. 9 is an enlarged view of a support device attached to a second display case support of the frame structure of FIG. 8.

With reference back to FIG. 1, the first sidewall 16 includes an upper portion 62 and, likewise, the second sidewall 18 includes an upper portion 64. The upper portions 62,64 are generally the portions of the first and second sidewalls 16,18 that extend above the top edges 28,30 of the first and second end walls 12,14. The distance that the upper portions 62,64 extend beyond the top surfaces or edges 28,30 is variable. More specifically, the distance the upper portions 62,64 extend beyond the top surfaces 28,30 may be selected depending upon how many display cases the frame structure A is intended to hold. For example, the upper portions 62,64 of the first preferred embodiment shown in FIG. 1 extend a selected distance beyond the top surfaces 28,30 of the first and second end walls 12,14 to support a single or first display case D above the base display case B. Whereas, the second preferred embodiment shown in FIG. 9 has upper portions that extend a selected distance beyond top surfaces of first and second end walls to accommodate a pair of stacked display cases D and E.

With continuing reference to FIG. 1, a first pair of slide mechanisms 70,72 are mounted on the upper portions 62,64 of the sidewalls 16,18. More specifically, the first slide mechanism 70 is mounted on the first sidewall 16 and the second corresponding slide mechanism 72 is mounted on the second sidewall 18. The slide mechanisms 70,72 are generally parallel and coplanar with one another. In the first preferred embodiment, the slide mechanisms are shown as being movable over the top edge 28 of the first end wall 12. In alternate embodiments the slide mechanisms can be modified or substituted for such that they are moveable over the top edge 30 of the second end wall 14 or movable over both top edges 28,30 of the first and second end walls 12,14.

Figure 4:
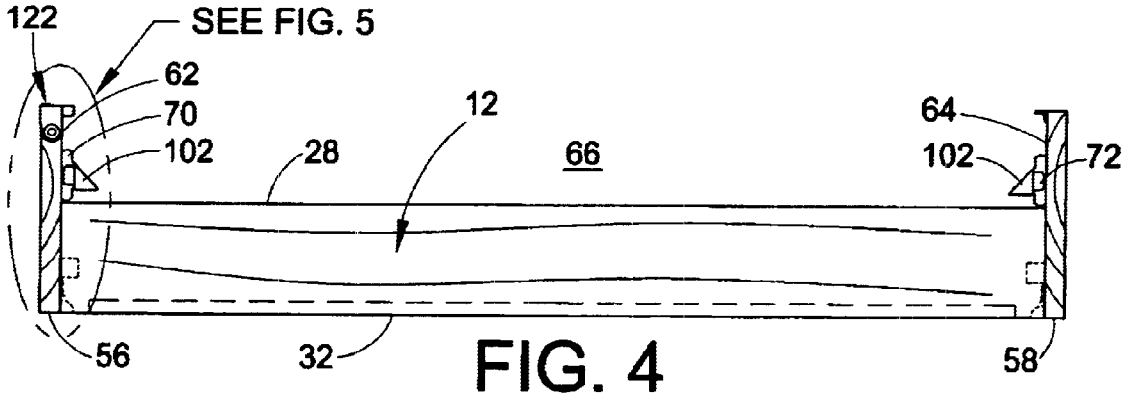
FIG. 4 is a front elevational view of the frame structure of FIG. 1.

With reference to FIG. 4, a first region 66 is defined between the upper portions 62,64. More specifically, with additional reference to FIG. 1, the first region 66 is defined between the respective first ends 44,48 of the first and second sidewalls 16,18 and the second ends 46,50 of the first and second sidewalls 46,50. Additionally, the first region 66 is defined between a plane parallel to the first and second end wall top edges 28,30 and a plane parallel to the first and second sidewall top edges 52,54.

The slide mechanisms 70,72 are capable of slidably supporting a first display case support 74,76. The first display case support 74,76 may be constructed of first track member 74 and second track member 76. The first and second track members 74,76 are "L" shaped members connected to the first and second slide mechanisms 70,72. The first and second track members 74,76 are capable of supporting the first display case D. The slide mechanisms 70,72 are capable of slidably moving the first display case D carried by the first and second track members 74,76 between a first position wherein the first display case D is positioned within the first region 66 substantially obstructing viewing into the base cavity 60 or the base display case B if contained therein and a second extended position wherein the first display case D is slid forward from the frame structure A as shown in FIG. 1. With the first display case D in the second, extended position, the base cavity 60 is not substantially obstructed by the first display case D.

Figure 7:
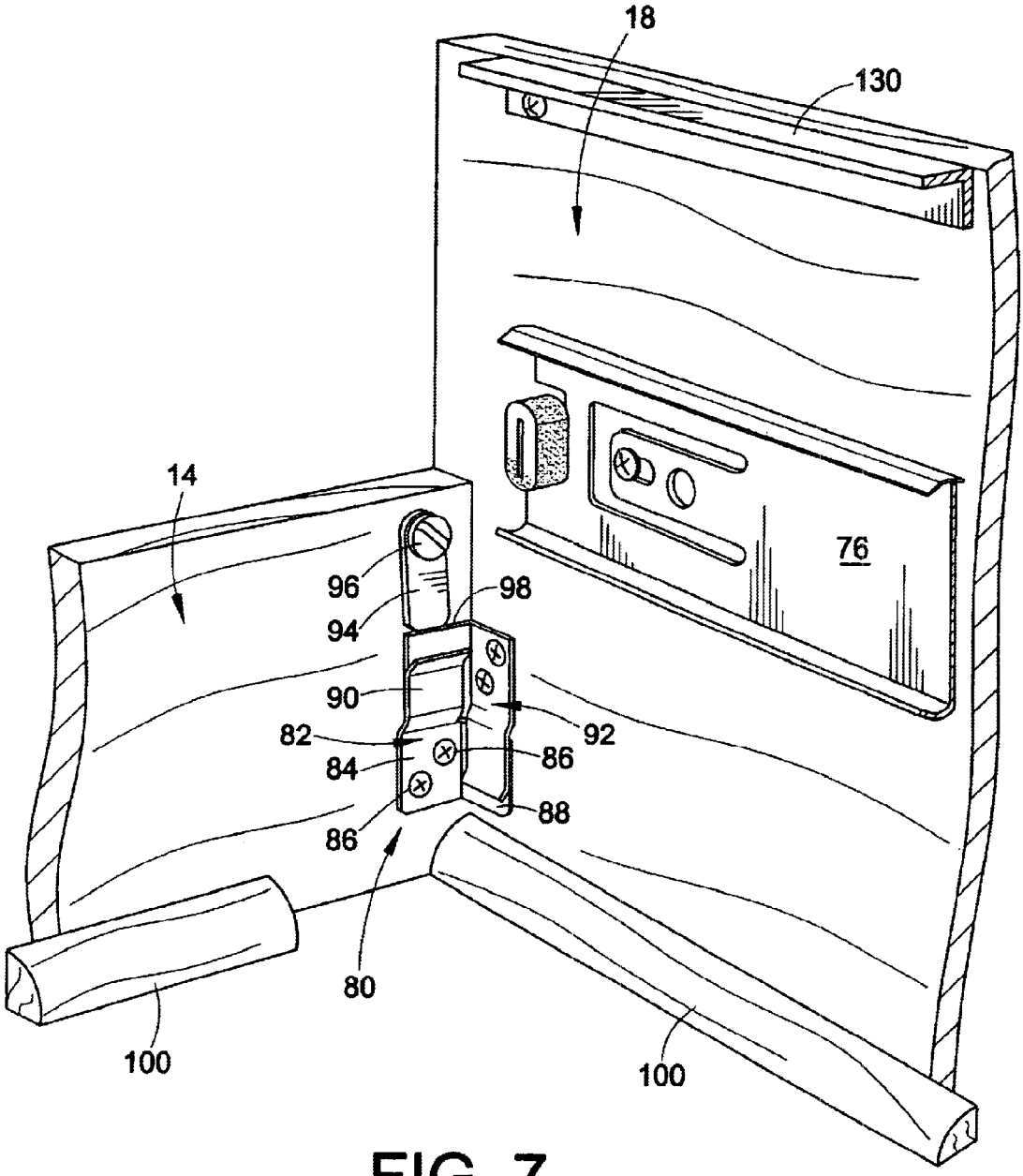
FIG. 7 is a partial enlarged perspective view of the connection between a second end wall and a second sidewall of the frame structure of FIG. 1.

The first and second end walls 12,14 and the first and second sidewalls 16,18 are interconnected by a plurality of fastener sets 80. With reference to FIG. 7, each fastener set includes a first fastener member 82. The first fastener member 82 includes a mounting portion 84 having openings therein for receiving screws 86. The screws 86 securely mount the first fastener member 82 to a desired wall such as second end wall 14 shown in FIG. 7. The first fastener member 82 additionally includes an abutting tab 88 that abuts an adjacent wall such as first sidewall 18 shown in FIG. 7. The first fastener member 82 also includes a receiving tab 90 used to matingly engage with a second fastener member 92. The second fastener member 92 is substantially similar to the first fastener member except that it is inverted. A pivotable lock member 94 is secured to the wall 14 for locking the engagement between the first and second fastener members 82,92. More specifically, the lock member 94, when in a locked position, prevents the first and second fastener members from being disconnected.

Figure 6:
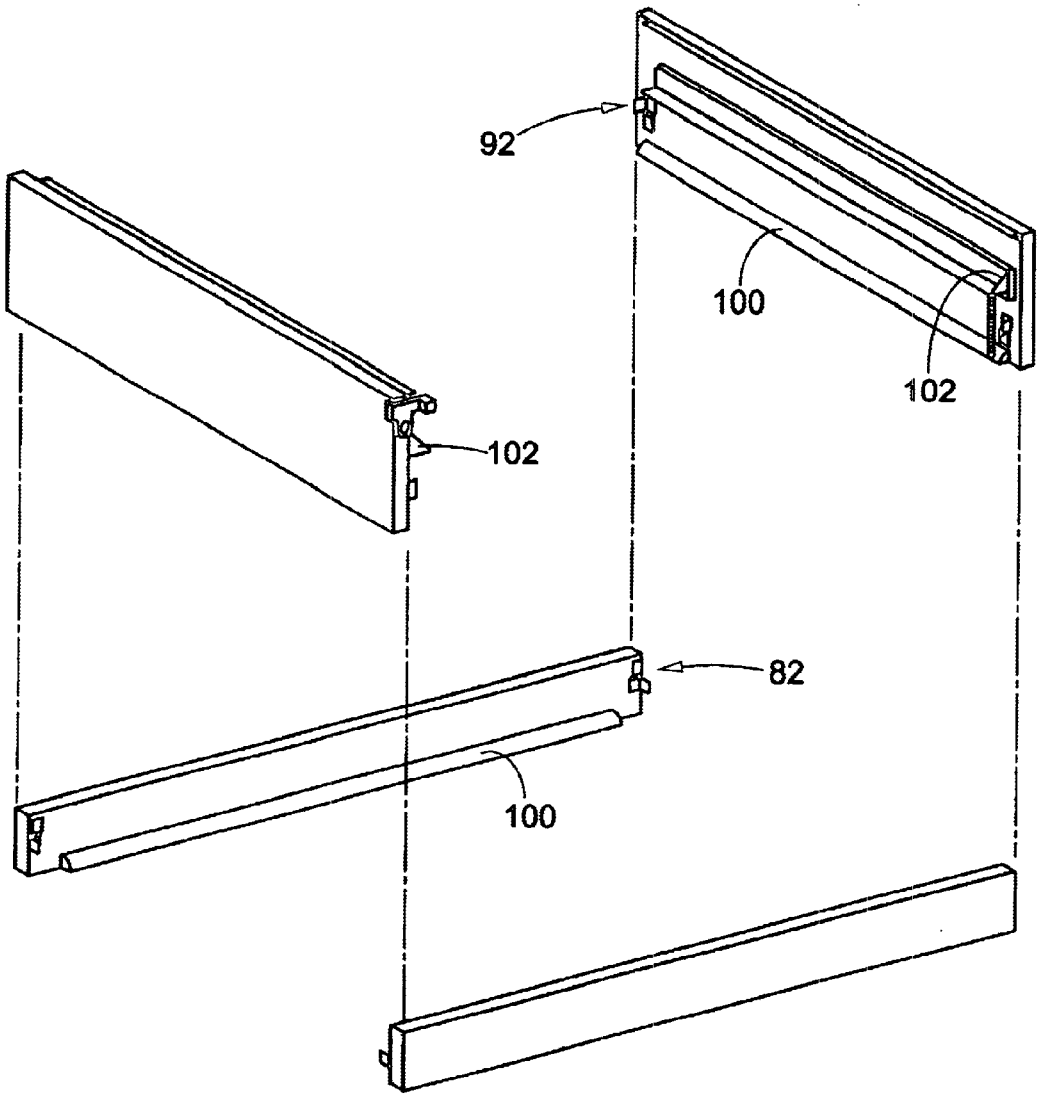
FIG. 6 is an exploded perspective view of the frame structure of FIG. 1.

Each of the plurality of fastener sets 80 each work in the same manner as the first and second fasteners 82,92 described herein. With additional reference to FIG. 6, the plurality of fastener sets 80 permit the frame structure to be assembled and disassembled by merely moving the sidewalls 16,18 vertically relative to the end walls 12,14. The fastener sets 80 are readily connectable and disconnectable which permits easy assembly and disassembly of the frame structure A. Thus, no tools are required for connecting and disconnecting the sidewalls 16,18 and the end walls 12,14.

Lock members are used with each fastener set 80 in the preferred embodiment shown and described herein. The lock members are movable between a locked position such as the position of the lock member 94 shown in FIG. 7 wherein the sidewalls 16,18 and the end walls 12,14 are prevented from being readily disconnected. The lock members are each pivotable or moveable to an unlocked position which then permits the walls 12–18 to be disconnected from one another. With specific reference to FIG. 7, the lock member 94 engages the top edge 98 of the inverted fastener member 92.

With reference to FIG. 1, a plurality of base rails 100 are attached to each of the walls 12–18 adjacent respective bottom edges thereof. Base rails 100 are generally quarter round pieces that are used to center the base display case B with the cavity 60. In the first preferred embodiment of FIG. 1, base rails 100 are provided along each of the wall 12–18. However, it is to be appreciated that other configurations of base rails 100 are permitted. For example, the base rails 100 may be provided only on the end walls 12,14 or may only be provided on the sidewalls 16,18.

The first display case support, first and second track members 74,76 in the first preferred embodiment, includes a slide support such as support brackets 102. Support brackets 102 can be positioned at one or both ends of the track members 74,76. The support brackets 102 prevent the carried first display case D from sliding off the track members 74,76 in the direction of the support brackets 102. With specific reference to FIG. 1, the track members 74,76 each include a support bracket 102 positioned at respective front track member ends 104 of the track members 74,76.

Figure 5:
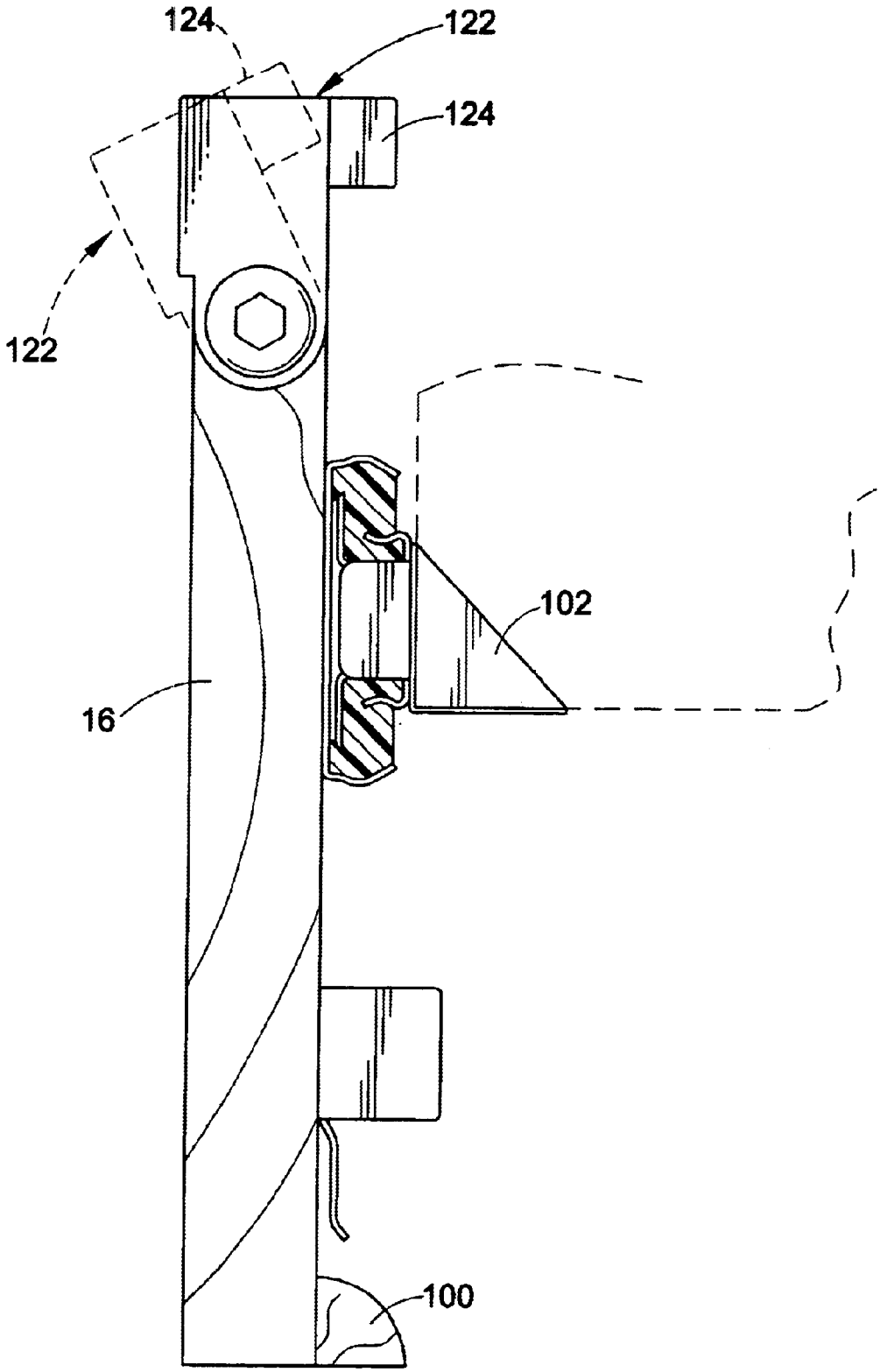
FIG. 5 is a partial enlarged front elevational view of the frame structure of FIG. 1.

With reference to FIG. 1, a lock mechanism 122 is provided on the first sidewall 16 at the first end 44 thereof adjacent the top surface 52. The lock mechanism is pivotally mounted to the first side 44. With additional reference to FIG. 5, the lock mechanism 122 is movable between a first locking position wherein a tab 124 of the lock mechanism 122 protrudes inward relative to the first sidewall 16 and a second position wherein a tab 124 does not protrude inward of the first sidewall 16.

The lock mechanism is used to lock the first display case D in the first position or in the second extended position. For example, when the first display case D is in the first position adjacent and above the base cavity 60 and within the first region 66, the lock mechanism 122 in the locked position prevents the first display case D from moving toward the second extended position. Upon moving the lock mechanism 122 to the unlocked position, the first display case D may be moved to the second, extended position. When the first display case D is in the second extended position, the lock mechanism 122 may be put into the lock position such as shown in FIG. 1 thereby preventing the first display case D from moving back toward the first position and into the first region 66. Of course, when the lock mechanism is moved to the unlock position, the first display case D may freely move back to the first position.

Figure 3:
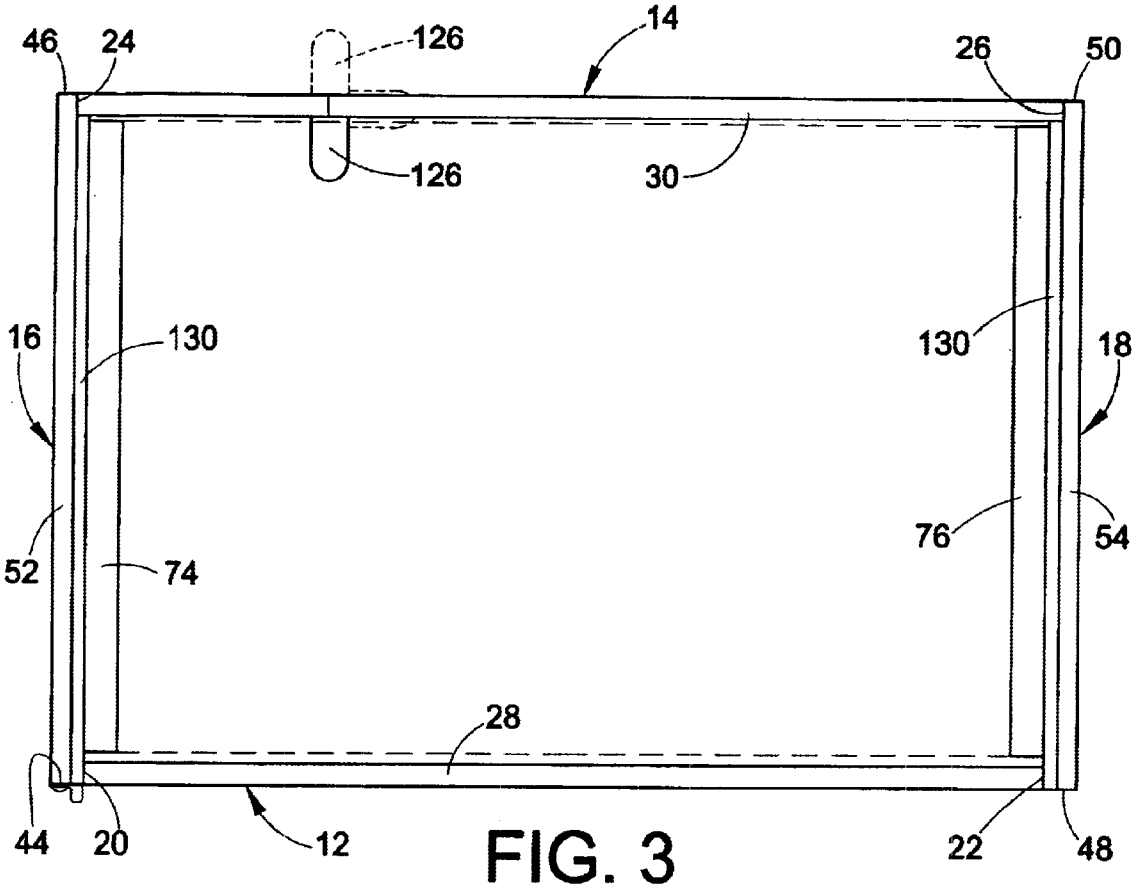
FIG. 3 is a plan view of the frame structure of FIG. 1 showing a first display case support of the frame structure in a closed position.

The second end wall 14 may alternatively include a stabilizer member 126. Stabilizer member 126 is pivotably attached to the bottom edge or surface 34 of the second end wall 14. The stabilizer member 126 is movable from a position generally parallel to the second end wall 14 to a position wherein the stabilizer member 126 is approximately normal to the second end wall 14. More specifically, the stabilizer member 126 may be pivoted from its parallel position such that it extends inward in the direction of the first end wall 12 (as shown in phantom in FIG. 1) or may be pivoted to a position that extends outward of the second end wall 14 away from the first end wall 12 (as shown in FIG. 3). When in the position extending inward, the stabilizer member 126 will be held in position by the base support case B thereby adding stability to the frame structure A. When in the outward position, the stabilizer member 126 may be held in position by another object positioned adjacent the frame structure A, such as another display case C.

With reference to FIGS. 1 and 7, a gap member 130 is provided on each of the first and second sidewalls 16,18. With additional reference to FIG. 4, the gap member 130 fills a gap created by the slide mechanisms 70,72. More specifically, the slide mechanisms 70,72 position a carried first display case D slightly away from the first and second sidewalls 16,18. The gap members 130 serve to fill the gaps created thereby. Alternatively, the slide mechanisms 70,72 may be mounted in a manner that eliminates gaps and the need for gap members 130 between the sidewalls 16,18 and the display case D. For example, the sidewalls 16,18 could be milled out to define recesses for mounting the slide mechanisms 70,72 flush with the sidewalls 16,18.

Figure 8:
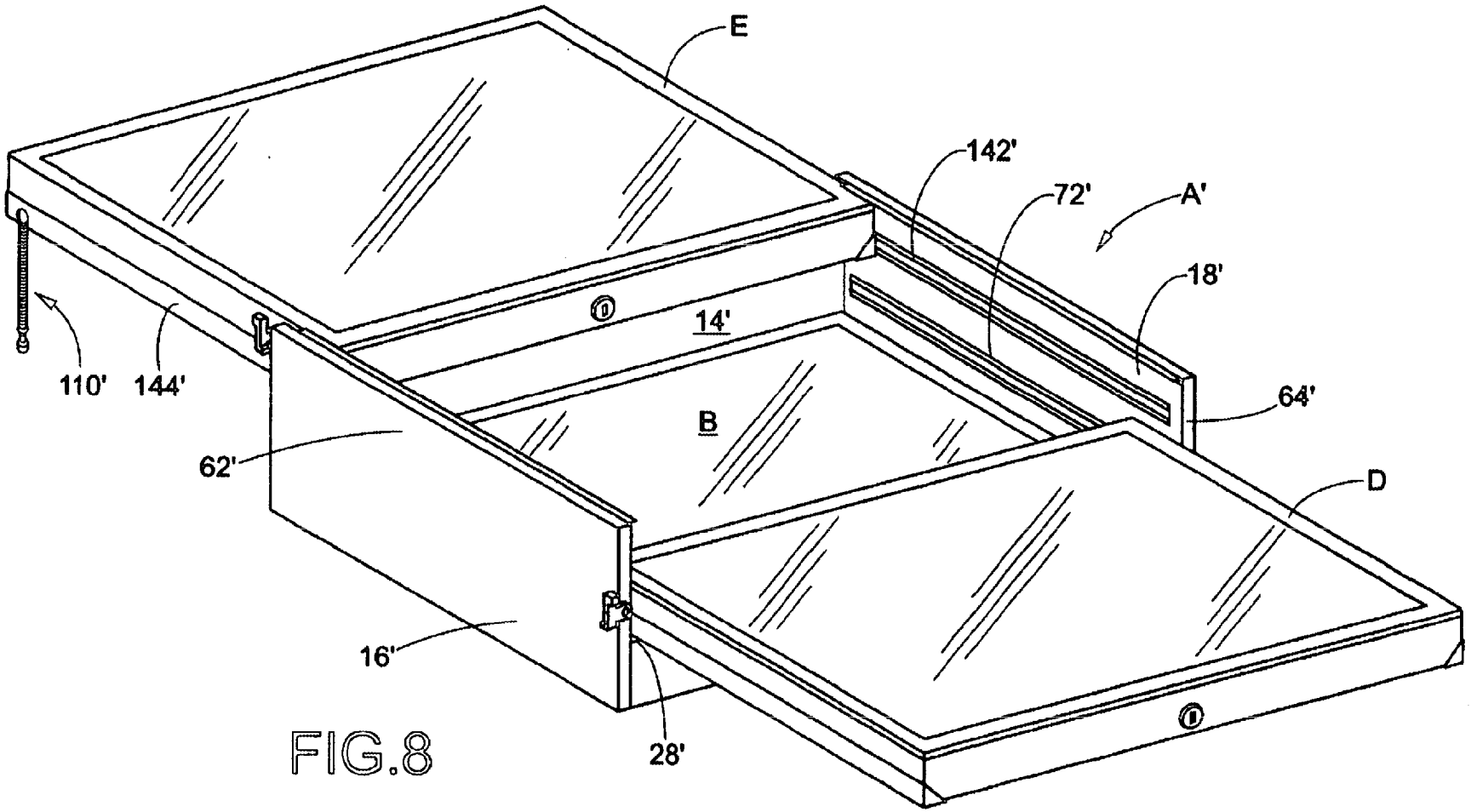
FIG. 8 is a perspective view of a frame structure for holding a plurality of display cases having a first display case support in a forward open position and a second display case support in a rearward open position in accordance with a second preferred embodiment of the present invention.

With reference to FIG. 8, a frame structure A' is shown in accordance with a second preferred embodiment of the present invention. The frame structure A' is similar to the frame structure A of FIG. 1 except that the frame structure A' is adapted to hold three display cases, namely, the base display case B, the first display case D and a second display case E. Pieces or components of the frame structure A' that are same or similar to pieces of the frame structure A are designated with the same reference numerals except that reference numerals of the frame structure A' include a prime mark (') after the reference numeral.

More specifically, the frame structure A' includes a pair of sidewalls 16',18' that have upper portions 62',64' that extend beyond top surfaces or edges 28',30' a selected distance in order to support the pair of display cases D, E above the base display case B. The upper portions 62',64' have a pair of first slide mechanisms 70',72' mounted thereon and a second pair of slide mechanisms 140',142' mounted thereon. The second pair of slide mechanisms 140',142' are mounted above the first pair of slide mechanisms 70',72'.

A second display case support 144',146' is connected to the second pair of slide mechanisms 140',142' for carrying the second display case E. The second pair of slide mechanisms 140',142' are capable of slidably moving the second display case E between a first position (not shown) wherein the second display case E would be positioned over the base display case B substantially obstructing viewing into the base display case B or the cavity 60' that the base display case B occupies and a second position wherein the second display case E passes over the top edge 30' (not shown) of a second end wall 14' thereby not substantially obstructing viewing into the base display case B on the base cavity 60'.

The second slide mechanisms 140',142' are mounted a sufficient distance above the first slide mechanisms 70',72' to provide a clearance between the first display case D and the second display case E. The upper portions 62',64' define a first region 66' and a second region adjacent and above the first region. The first region 66' receives the first display case D when it is in its first position and the second region receives the second display case when it is in its first position. It should be appreciated that although the embodiments shown and described are only adapted to carry two and three display cases, respectively, it is contemplated that the present invention could be modified to carry any number of display cases.

The second display case support 144',146' additionally includes a support device 110' for providing support to the carried second display case E when the second display case E is in the extended position. More specifically, the support device 110' extends downward from the second display case support 144',146'. With additional reference to FIG. 8, the support device 110' includes a resilient portion 112', such as a spring, allowing the support device 110' to be flexible. This resiliency is included to limit the ability of the support device 110' from being able to pinch one's fingers when the second display case support 144',146' is moved between its first and second positions.

The support device 110' is fastened to the second display case support 144',146' by a fastener such as screw 114'. Support device 110' additionally includes a rubber head portion 116' at a distal end thereof and an adjustable section 118' that allows the length of support device to be adjusted to a desired length.

Additionally, although the first display case D is shown as passing over only the top edge 28 in the first preferred embodiment and 28' in the second preferred embodiment, either embodiment could be modified such that the first display case D is capable of passing over only its top edge 30 or 30' or both its the top edges 28,30 or 28',30'. Likewise, although the second display case E is shown as passing over only the top edge 30', the second preferred embodiment could be modified such that the second display case E is capable of passing over the top edge 28' or both top edges 28' and 30'.

Another option is contemplated where the display frame A or A' is constructed or positioned at an angle to permit easier viewing of the display case contents by customers. For example, the display frame could be constructed so that each display case resides at an angle such as about fifteen degrees to about forty-five degrees. The tilt would permit better viewing into the display cases.

The invention has been described with reference to the preferred embodiment. Obviously, modifications and alterations will occur to other upon reading and understanding the preceding detailed description. It is intended that the invention be construed as including all such modifications and alterations insofar as they are within the scope of the appended claims or the equivalents thereof.

Having thus described the preferred embodiments, the invention is now claimed to be:

1. A frame structure for holding a plurality of display cases, each of the plurality of display cases having an upper end and an inner cavity viewable through the upper end, the frame structure adapted to permit viewing of each of the upper ends of the plurality of display cases, the frame structure comprising:

a first end wall having first and second ends and a top edge;

a second end wall spaced apart from the first end wall in generally parallel orientation relative to the first end wall, the second end wall having first and second ends and a top edge;

a pair of sidewalls extending between the first and second end walls, a first sidewall of the pair of sidewalls connected at a first end to the first end wall first end and at a second end to the second end wall first end, a second sidewall of the pair of sidewalls connected at a first end to the first end wall second end and at a second end to the second end wall second end, the end walls and sidewalls defining a base cavity adapted to receive an associated base display case, the pair of sidewalls having upper portions that extend a selected distance beyond the top edges of the first and second end walls;

a first pair of slide mechanisms mounted on the upper portions of the pair of sidewalls, a first slide mechanism of the first pair of slide mechanisms mounted on the first sidewall and a second corresponding slide mechanism of the first pair of slide mechanisms mounted on the second sidewall; and a first display case support connected to the first pair of slide mechanisms and adapted to carry an associated first display case, the first pair of slide mechanisms capable of slidably moving the first display case support between a first position wherein the carried associated first display case is positioned over the base cavity substantially obstructing viewing into the base cavity and a second position wherein the carried associated display case passes over one of the top edges of the first and second end walls thereby not substantially obstructing viewing into the base cavity.

2. The frame structure of claim 1 further comprising:

a second pair of slide mechanisms mounted on the upper portions of the pair of sidewalls above the first pair of slide mechanisms, a first slide mechanism of the second pair of slide mechanisms mounted on the first sidewall and a second corresponding slide mechanism of the second pair of slide mechanisms mounted on the second sidewall; and a second display case support connected to the second pair of slide mechanisms for carrying an associated second display case, the second pair of slide mechanisms capable of slidably moving the second display case support between a first position wherein the carried associated second display case is positioned over the associated first display case when the associated first display case is in the first position thereby substantially obstructing viewing into the base cavity and a second position wherein the carried associated second display case would pass over one of the top edges of the first and second end walls thereby not substantially obstructing viewing into the base cavity, the second pair of slide mechanisms mounted on the upper portions a sufficient distance above the first pair of slide mechanisms to provide clearance between the associated first display case and the associated second display case.

3. The frame structure of claim 2 wherein the first pair of slide mechanisms and the first display case support member are capable of moving the first associated display case over the top surface of the first end wall and the second pair of slide mechanisms and the second display case are capable of moving the second associated display case over the top surface of the second end wall.

4. The frame structure of claim 1 wherein the display case support is a pair of track members adapted to support lateral sides of the associated first display case.

5. The frame structure of claim 1 further comprising:

a plurality of fasteners for connecting the first end of the first sidewall to the first end wall first end and the second end of the first sidewall to the second end wall first end and for connecting the first end of the second sidewall to the first end wall second end and the second end of the second sidewall to the second end wall second end, wherein the plurality of fasteners are readily connectable and disconnectable permitting assembly and disassembly of the frame structure.

6. The frame structure of claim 5 wherein the fasteners do not require tools for connecting and disconnecting the sidewalls and end walls.

7. The frame structure of claim 5 further comprising:

lock members movable between a locked position preventing connected sidewalls and end walls from being readily disconnected and an unlocked position allowing connected sidewalls and end walls to be readily disconnected.

8. The frame structure of claim 1 wherein at least one of the first and second sidewalls and first and second end walls includes base rails adjacent base edges of the at least one of the first and second sidewalls and the first and second end walls, the base rails adapted to center the associated base display case.

9. The frame structure of claim 1 wherein the first display case support includes a slide support adapted to restrict movement of the first associated display case in a direction parallel with a longitudinal extent of the track members beyond at least one end of the track members.

10. The frame structure of claim 9 wherein the slide support is a pair of support brackets.

11. The frame structure of claim 1 wherein the first display case support includes a support device extending downward therefrom for supporting the first display case support when the first display case support is in its second position.

12. The frame structure of claim 11 wherein the support device is a resilient member.

13. The frame structure of claim 11 wherein the support device includes an adjustable means for extending the length of the support device.

14. The frame structure of claim 1 further comprising a stop mechanism for locking the first display case in at least one of its first position and its second position.

15. The frame structure of claim 1 further comprising a pivotable stabilizing member connected to a base surface of one of the first end wall, the second end wall, the first sidewall and the second sidewall.

16. The frame structure of claim 1 further comprising a gap member connected to at least one of the upper portions above one of the first and second slide mechanisms for substantially occupying the gap created by the one of the first and second slide mechanisms between the one of the upper portions and the location of a sidewall of the associated first display case.

17. A transportable display system for holding and viewing one or more display cases that can be readily assembled and disassembled without the use of tools, comprising:

a first sidewall;

a second sidewall releasably connected to the first sidewall and spaced apart from the first sidewall, the second sidewall capable of being readily disconnected and reconnected to the first sidewall without the use of tools thereby enabling the display system to be readily assembled and disassembled for transport thereof;

a first region disposed between the first and second sidewalls; and a first pair of slide members disposed on the first and second sidewalls for supporting an associated display case within the first region, the slide members movable for transporting the associated first display case toward a position outside the first region.

18. The display system of claim 17 wherein a base region is disposed adjacent and below the first region for occupancy by an associated base display case.

19. The display system of claim 17 further comprising:

a second region disposed between the first and second sidewalls and positioned adjacent and above the first region; and a second pair of slide members disposed on the first and second sidewalls for supporting an associated second display case within the second region, the second pair of slide members movable for transporting the associated second display case toward a position outside the first region.

20. The frame structure of claim 12 wherein the resilient member is a spring.

21. A frame structure for holding a plurality of display cases, each of the plurality of display cases having an upper end and inner cavity viewable through the upper end, the frame structure adapted to permit viewing of each of the upper ends of the plurality of display cases, the frame structure comprising:

a first end wall having first and second ends and a top edge;

a second end wall spaced apart from the first end wall in generally parallel orientation relative to the first end wall, the second end wall having first and second ends and a top edge;

a pair of spaced apart sidewalls extending between the first and second end walls, the end walls and sidewalls defining a base cavity adapted to receive an associated base display case, the pair of sidewalls having upper portions that extend a selected distance beyond at least one of the top edges of the first and second end walls;

a first pair of slide mechanisms mounted on the upper portions of the pair of sidewalls, a first slide mechanism of the first pair of slide mechanisms mounted on the first sidewall and a second corresponding slide mechanism of the first pair of slide mechanisms mounted on the second sidewall; and a first display case support connected to the first pair of slide mechanisms and adapted to carry an associated first display case, the first pair of slide mechanisms capable of slidably moving the first display case support between a first position wherein the carried associated first display case is positioned over the base cavity and a second position wherein the carried associated display case passes over one of the top edges of the first and second end walls.

* * * * *